United States Patent [19]

Sperry

[11] 4,159,011

[45] Jun. 26, 1979

[54] ENGINE CYLINDER INLET PORT

[75] Inventor: Kenneth D. Sperry, Fraser, Mich.

[73] Assignee: General Motors Corporation, Detroit, Mich.

[21] Appl. No.: 879,892

[22] Filed: Feb. 21, 1978

[51] Int. Cl.[2] ..... F02F 1/42

[52] U.S. Cl. ..... 123/52 M; 123/188 M; 123/193 H

[58] Field of Search ..... 123/52 R, 52 M, 188 R, 123/188 M, 188 S, 193 H, 193 CH

[56] References Cited

U.S. PATENT DOCUMENTS

| | | | |
|---|---|---|---|
| 3,045,655 | 7/1962 | Formia | 123/188 M |
| 3,273,551 | 9/1966 | Julien et al. | 123/188 M |
| 3,430,614 | 3/1969 | Meacham | 123/193 H |
| 3,557,766 | 1/1971 | Stark | 123/188 M |
| 3,590,797 | 7/1971 | Blank | 123/188 M |

FOREIGN PATENT DOCUMENTS

| | | | |
|---|---|---|---|
| 324404 | 11/1976 | U.S.S.R. | 123/188 M |
| 1243587 | 8/1971 | United Kingdom | 123/188 M |

*Primary Examiner*—Charles J. Myhre
*Assistant Examiner*—Craig R. Feinberg
*Attorney, Agent, or Firm*—Robert J. Outland

[57] ABSTRACT

Airflow through a sharply curved engine cylinder inlet port is increased by provision of a flow detector comprising a particularly shaped free standing bump on the floor of the port's entrance portion and appropriately spaced from the sharply curved wall leading to the port's throat portion. Fairing of a valve guide protrusion in the port roof is also provided to further direct the airflow.

4 Claims, 7 Drawing Figures

ENGINE CYLINDER INLET PORT

BACKGROUND OF THE INVENTION

This invention relates to internal combustion engines and, more particularly, to configurations of engine cylinder inlet ports for conducting air or air-fuel mixture to the cylinders of such engines.

It is well known in the art of internal combustion engines to provide for each cylinder an inlet port which opens through the closed end of its respective cylinder and is controlled by a poppet inlet valve. The port provides a passage way by which air or air-fuel mixture are conducted to the cylinder for burning, expansion and subsequent exhaust in known manner.

The inlet port and the associated poppet valve restrict, to an extent dependent on their size and shape, the amount of air or mixture flow which can be drawn into the engine cylinder during the induction stroke when the intake poppet valve is closed. Thus, the valves and their associated ports are generally made as large as possible within the limits imposed by other engine requirements and the inlet ports are made as short and free from turns and protuberances as is consistent with other design considerations in order to minimize to the extent possible the restriction to airflow provided by the port and associated valve. Often, however, it is necessary for the best overall engine configuration to provide a relatively sharp angular bend in the inlet port to connect a throat portion that opens through the cylinder closed end with an entrance portion extending laterally out through a side wall of the port-defining cylinder head or engine block.

SUMMARY OF THE INVENTION

The present invention provides a modified and improved port configuration for sharply angled engine inlet ports of the sort just referred to wherein a specially designed flow deflector is provided which, while appearing to provide an interference to airflow through the port, actually decreases the effective restriction and improves flow through the port and into the cylinder. The deflector comprises a free standing bump, laterally centered in a flattened floor of the port entrance portion. The bump has sloping sides which have an average width about half the port width and it's center ridge rises gently upward in the direction of airflow toward the cylinder to a height of about one-quarter to one-third of the port height. The bump then curves sharply downward to end abruptly short of the sharply curved wall portion that connects with the throat, ending at a radial (to the valve axis) distance from the near side of the throat portion equal to about half the throat diameter. The novel configuration increases the flow of air through the port, apparently by forming a low pressure area beyond the deflector that assists turning of the airflow around the sharply curved wall portion, thereby more uniformly distributing airflow through the annular area formed between the valve and the port when the valve is opened.

In another feature of the port design, a fairing is provided to smoothly blend the leading edge of a protruding valve guide portion with the upstream portion of the port roof.

These and other features of the invention will be more fully understood from the following description of preferred embodiment taken together with the accompanying drawings.

DESCRIPTION OF A PREFERRED EMBODIMENT

Figure 1:
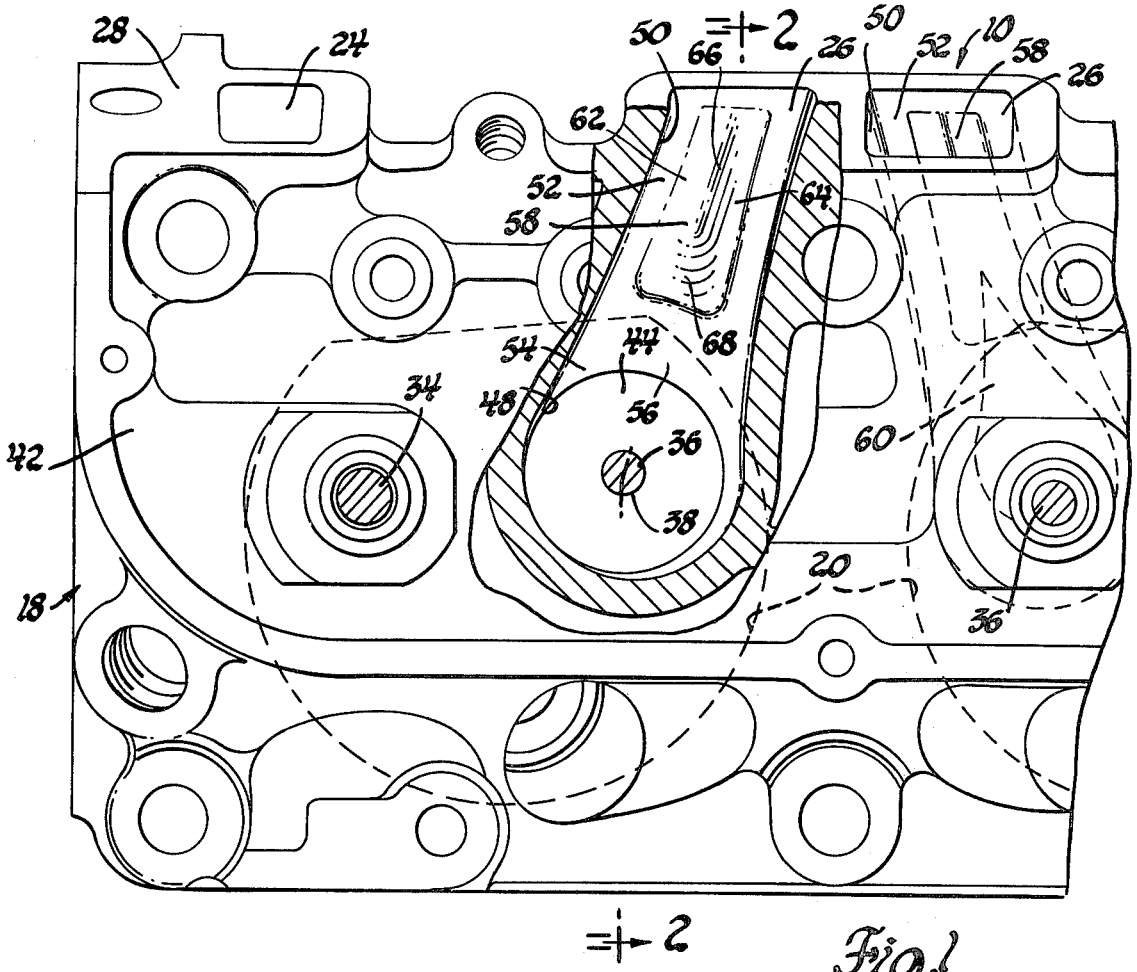
FIG. 1 is a partial top view of an internal combustion engine showing the cylinder head having associated components removed for clarity and partially broken away to disclose the interior of one of the cylinder inlet ports.
Figure 2:
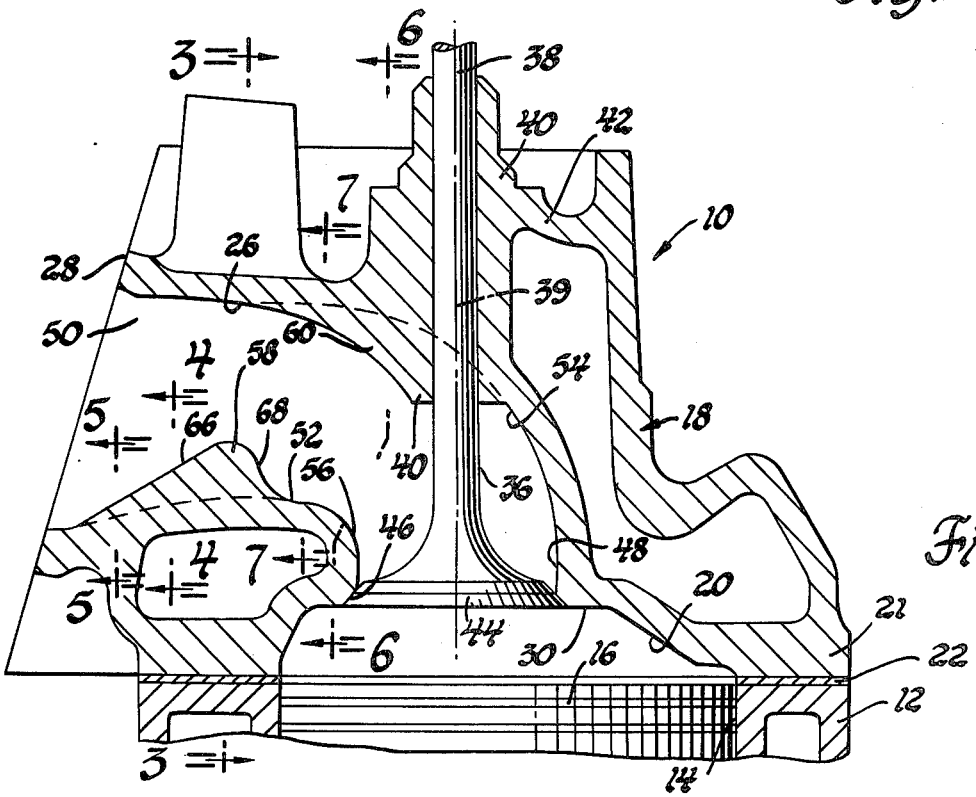
FIG. 2 is a transverse cross-sectional view taken generally in the plane indicated by the line 2—2 of FIG. 1 and showing certain features of the engine and the above specified inlet port.
Figure 3:
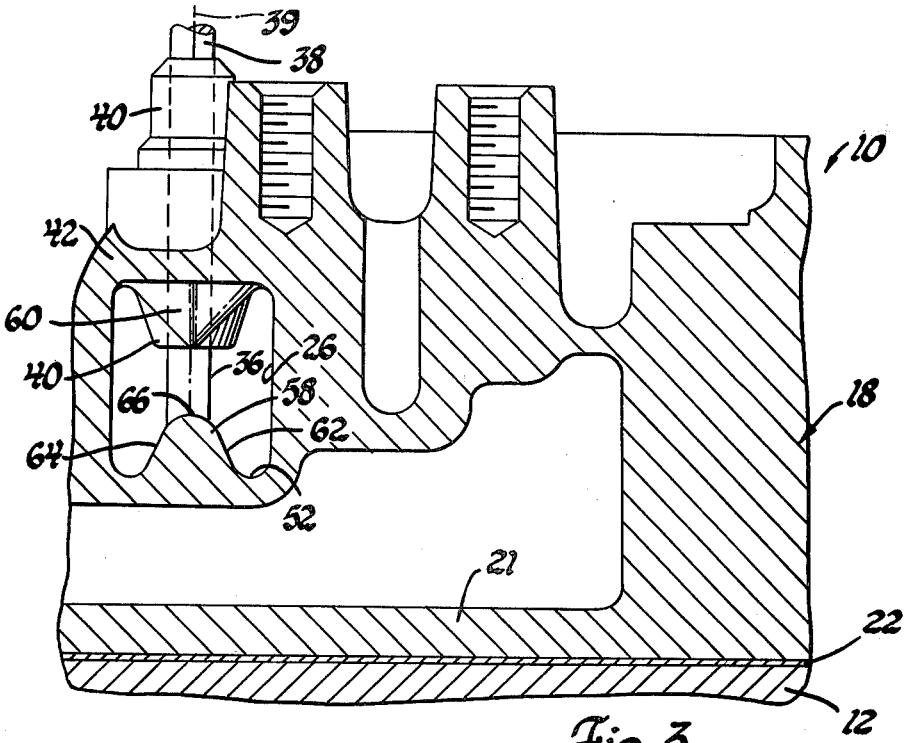
FIG. 3 is a longitudinal cross-sectional view taken in the plane indicated by the line 3—3 of FIG. 2 and showing further features of the engine and said inlet port.
Figure 4:
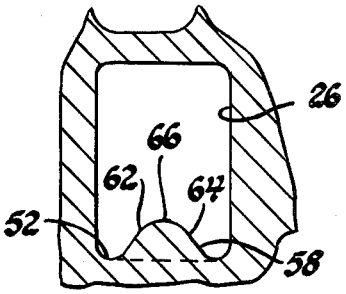
FIGS. 4–7 are fragmentary longitudinal cross-sectional views taken respectively in the planes indicated by the lines 4—4, 5—5, 6—6 and 7—7 of FIG. 2 and further illustrating the configuration of the said inlet port.
Figure 5:
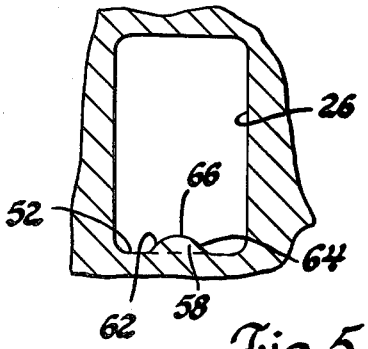
Figure 6:
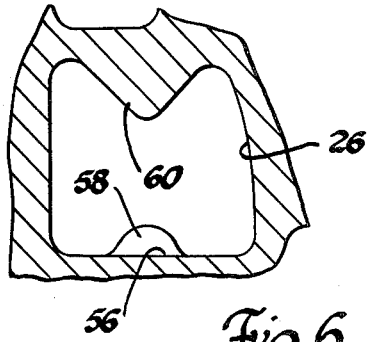
Figure 7:
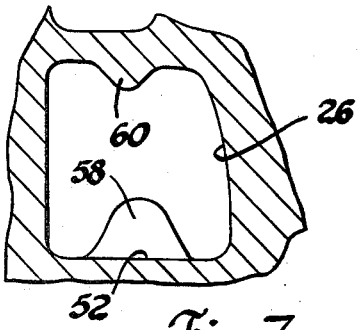

Referring now to the drawings in detail, there is shown, for explanation and not limitation of the invention, an internal combustion engine generally indicated by numeral 10 and of a type suitable for use in an automotive vehicle. Engine 10 has a cylinder block 12 defining a plurality of cylinders 14 (only one being shown) each having a piston 16 reciprocable within it, the pistons being connected in conventional manner to a crankshaft, not shown.

The upper ends of the cylinders 16 are closed by a cylinder head 18 having at each cylinder location a combustion chamber recess 20 formed in a bottom wall 21 that sealingly engages the top of the cylinder block through a gasket 22 which surrounds each of the cylinder and combustion chamber openings.

At each combustion chamber recess the cylinder head is provided with an exhaust port 24 and an inlet port 26. These two ports 24, 26 open at their distal ends through a side wall 28 of the cylinder head and extend partially through the head to their respective combustion chamber recess 20, opening through the end wall of the cylinder in an upper flat roof portion 30 of the recess.

The exhaust ports 24 are of conventional configuration and do not form a novel part of the present invention, as embodied in the configurations of the inlet ports. Both the exhaust and inlet ports are conventionally closed by poppet valves 34, 36, respectively. Each inlet valve 36 has a stem 38 that is reciprocable on an axis 39 in a valve guide 40 formed as a part of the cylinder head upper wall 42. The stem extends into the inlet port 26 and carries a mushroom head 44 that engages an annular seat 46 formed at the end of the inlet port where it opens into the cylinder at its combustion chamber recess.

Each inlet port itself includes a throat portion 48 of generally circular cross section and aligned with the valve axis 39. The throat portion opens into the cylinder at the valve seat 46 and is adapted to be closed by engagement of the inlet valve head with the valve seat. The inlet port further includes an entrance portion 50 opening through the side wall 28 and having a flattened floor 52 spaced closely to the throat portion and extending at a sharp angle to the direction of the axis. In the disclosed embodiment, the directions of the port entrance portion and its flattened floor are about normal (at a right angle) to the valve axis. A curved connecting portion 54 connects the axially directed generally cylindrical throat portion with the laterally directed generally rectangular entrance portion, the connecting portion including a sharply curved wall portion 56 that connects the flattened floor 52 with the adjacent part of the throat portion 48.

There are two protrusions in the otherwise generally smooth walls of the inlet port. These are the lower end of the valve guide 40 and a novel flow deflector 58 formed in accordance with the invention and to be subsequently described. The valve guide 40 extends downwardly partly into the port through the roof of the connecting portion 54. To reduce the airflow disruption from this protrusion, the leading edge of the guide is provided with a V-like fairing 60 leading from the bottom edge of the guide upwardly and in an upstream direction to the roof of the port entrance portion. The fairing tends to divide the flow of air or mixture passing through the port and direct it relatively smoothly around the protruding valve guide portion and the associated valve stem.

The flow deflector 58 comprises a free standing bump which is laterally centered in the flattened floor 52 of the port entrance portion 50. The bump has sloping sides 62, 64 rising to a center ridge 66 which extends gently upward in the direction of airflow toward the cylinder of a height of about one-quarter to one-third of the port height at that point. The sloping sides 62, 64 extend at their bottom edges to points near the edges of the port, but have an average width equal to only about half the port width. After reaching its peak height in the direction of airflow, the ridge or peak of the flow deflector bump curves sharply downward and ends abruptly at 68 on the flattened floor 52 short of the nearby connecting portion. The distance from the end of the flow deflector bump to the near side of the throat portion measured radially of the valve axis 39 is about equal to half the throat diameter.

The provision of such a flow deflector on the flattened floor of the inlet port entrance portion has been shown effective to increase the amount of airflow which the port will pass into the engine cylinder on the induction stroke of the piston in the higher airflow ranges. Flow tests indicated an increase in flow rate of up to about fifteen percent, with the inlet valve in its furthest open position. It is thought that the flow deflector causes this increase by creating, through its abrupt downward curvature short of the throat portion, a low pressure area shortly before the throat which has the effect of turning the airflow downwardly so that it flows smoothly against the sharply curved wall portion 56 and thereby utilizes better the flow area around the portion of the valve adjacent this wall portion. The effect, it is thought, is to better distribute the airflow through the complete annulus surrounding the valve when it is open and to avoid discontinuities in the flow due to the sharp curvature of wall portion 56 which, without the deflector, might result in a lesser amount of airflow passing by the valve adjacent this sharply curved wall portion.

The effect of this simple port design with its relatively sharp curvature and novel flow deflector, as well as the faired valve guide protrusion, is to provide a very efficient high flow short coupled port leading from a side wall of the cylinder head to a throat portion, opening through the end of the cylinder at a sharp angle from the entrance portion. In the specific embodiment disclosed, the valve axis is positioned essentially parallel to the axis of the cylinder. It should be understood however that, while the invention has been disclosed by reference to a specific and most preferred embodiment, numerous changes could be made in the various details of the disclosed arrangement without departing from the inventive features of the invention as disclosed herein. Accordingly, it is intended that the invention not be limited to the specific embodiment disclosed, but have the full scope permitted by the language of the following claims.

What is claimed is:

1. An internal combustion engine, including means defining a cylinder, closed at one end, and an inlet port communicating with the cylinder through said closed end, a poppet inlet valve disposed in the port and having head and stem portions reciprocable on an axis for controlling communication of the inlet port with the cylinder, said inlet port being characterized by a throat portion of generally circular cross-section aligned with said axis, said throat portion opening into the cylinder and adapted to be closed by the inlet valve at the cylinder closed end, an entrance portion having a floor spaced closely to the throat portion and extending at a sharp angle to the direction of said axis, and a connecting portion smoothly joining the throat and entrance portions and including a sharply curved wall portion connecting said floor with the adjacent part of the throat portion, said entrance portion including a flow deflector comprising a free standing bump laterally centered in and narrower than the floor, said bump rising gently upward in the direction of airflow toward the cylinder to a height of about one-fourth to one-third of the port height and then curving sharply downward to end abruptly short of the connecting portion, whereby a low pressure area is formed beyond the deflector that assists turning of the airflow around the sharply curved wall portion and thereby increases the maximum flow of air through the port upon opening of the valve.

2. An internal combustion engine, including means defining a cylinder, closed at one end, and an inlet port communicating with the cylinder through said closed end, a poppet inlet valve disposed in the port and having head and stem portions reciprocable on an axis for controlling communication of the inlet port with the cylinder, said inlet port being characterized by a throat portion of generally circular cross-section aligned with said axis, said throat portion opening into the cylinder and adapted to be closed by the inlet valve at the cylinder closed end, an entrance portion having a flattened floor spaced closely to the throat portion and extending at a sharp angle to the direction of said axis, and a connecting portion smoothly joining the throat and entrance portions and including a sharply curved wall portion connecting said flattened floor with the adjacent part of the throat portion, said entrance portion including a flow deflector comprising a free standing bump laterally centered in and narrower than the flattened floor and having sloping sides and an average width about half the port width, said bump rising gently upward in the direction of airflow toward the cylinder to a height of about one-fourth to one-third of the port height and then curving sharply downward to end abruptly short of the connecting portion and at a radial distance from the near side of the throat portion equal to about half the throat diameter, whereby a low pressure area is formed beyond the deflector that assists turning of the airflow around the sharply curved wall portion and thereby increases the maximum flow of air through the port upon opening of the valve.

3. A cylinder head for an internal combustion engine, said cylinder head having bottom and side walls and at least one inlet port opening through said walls, a poppet inlet valve disposed in the port and having head and stem portions reciprocable on an axis for controlling opening of the inlet port, said inlet port being characterized by a throat portion of generally circular cross-section aligned with said axis, said throat portion opening through said bottom wall and adapted to be closed by the inlet valve at said wall, an entrance portion opening through said side wall and having a flattened floor spaced closely to the throat portion and extending at a sharp angle to the direction of said axis, and a connecting portion smoothly joining the throat and entrance portions and including a sharply curved wall portion connecting said flattened floor with the adjacent part of the throat portion, said entrance portion including a flow deflector comprising a free standing bump laterally centered in the flattened floor and having sloping sides and an average width about half the port width, said bump rising gently upward in the direction of airflow toward the cylinder to a height of about one-fourth to one-third of the port height and then curving sharply downward to end abruptly short of the connecting portion and at a radial distance from the near side of the throat portion equal to about half the throat diameter, whereby a low pressure area is formed beyond the deflector that assists turning of the airflow around the sharply curved wall portion and thereby increases the maximum flow of air through the port upon opening of the valve.

4. A cylinder head as defined in claim 3 and further comprising valve guide means surrounding said valve stem for guiding the movements of said valve, said guide means having a portion protruding into said inlet port opposite said throat portion, and fairing means smoothly joining said protruding guide means portion with the wall of said port upstream of said guide means and opposite said bottom wall.

* * * * *

UNITED STATES PATENT AND TRADEMARK OFFICE

CERTIFICATE OF CORRECTION

PATENT NO. : 4,159,011

DATED : June 26, 1979

INVENTOR(S) : Kenneth D. Sperry

It is certified that error appears in the above-identified patent and that said Letters Patent are hereby corrected as shown below:

Abstract, line 2 "detector" should read --deflector--.

Column 1, line 20 "closed" should read --opened--.

Column 3, line 29 after "cylinder", "of" should read --to--.

Signed and Sealed this

*Sixteenth* Day of *October 1979*

[SEAL]

*Attest:*

RUTH C. MASON
*Attesting Officer*

LUTRELLE F. PARKER
*Acting Commissioner of Patents and Trademarks*